United States Patent [19]

Shaw

[11] 4,209,998

[45] Jul. 1, 1980

[54] AIR SOURCE HEAT PUMP WITH DISPLACEMENT DOUBLING THROUGH MULTIPLE SLIDE ROTARY SCREW COMPRESSOR/EXPANDER UNIT

[75] Inventor: David N. Shaw, Unionville, Conn.

[73] Assignee: Dunham-Bush, Inc., West Hartford, Conn.

[21] Appl. No.: 972,151

[22] Filed: Dec. 21, 1978

[51] Int. Cl.[2] ..... F25B 9/00; F04B 9/14

[52] U.S. Cl. ..... 62/324; 62/87; 417/237; 417/374

[58] Field of Search ..... 62/510, 324, 160, 87, 62/190; 237/2 B; 417/374, 237, 323

[56] References Cited

U.S. PATENT DOCUMENTS

| | | | |
|---|---|---|---|
| 3,321,930 | 5/1967 | La Fleur | 62/87 X |
| 3,932,159 | 1/1976 | Goldsberry | 62/87 X |

*Primary Examiner*—William E. Wayner

*Attorney, Agent, or Firm*—Sughrue, Rothwell, Mion, Zinn & Macpeak

[57] ABSTRACT

A closed loop refrigeration system such as an air source heat pump includes a hermetic screw compressor and a helical screw rotary expander connected to an electric induction drive motor. The closed loop refrigeration circuit permits an air source evaporator to constitute a heat source for supplying vaporized refrigerant to the compressor and expander, while both are mechanically coupled to the electric induction drive motor and with both driven as compression units. The air source evaporator feeds to slide valve controlled inlet ports of both the compressor and expander. Compressed vapor from both units passes to condenser coil(s) such as heating condensers to increase the system capacity under this mode.

2 Claims, 1 Drawing Figure

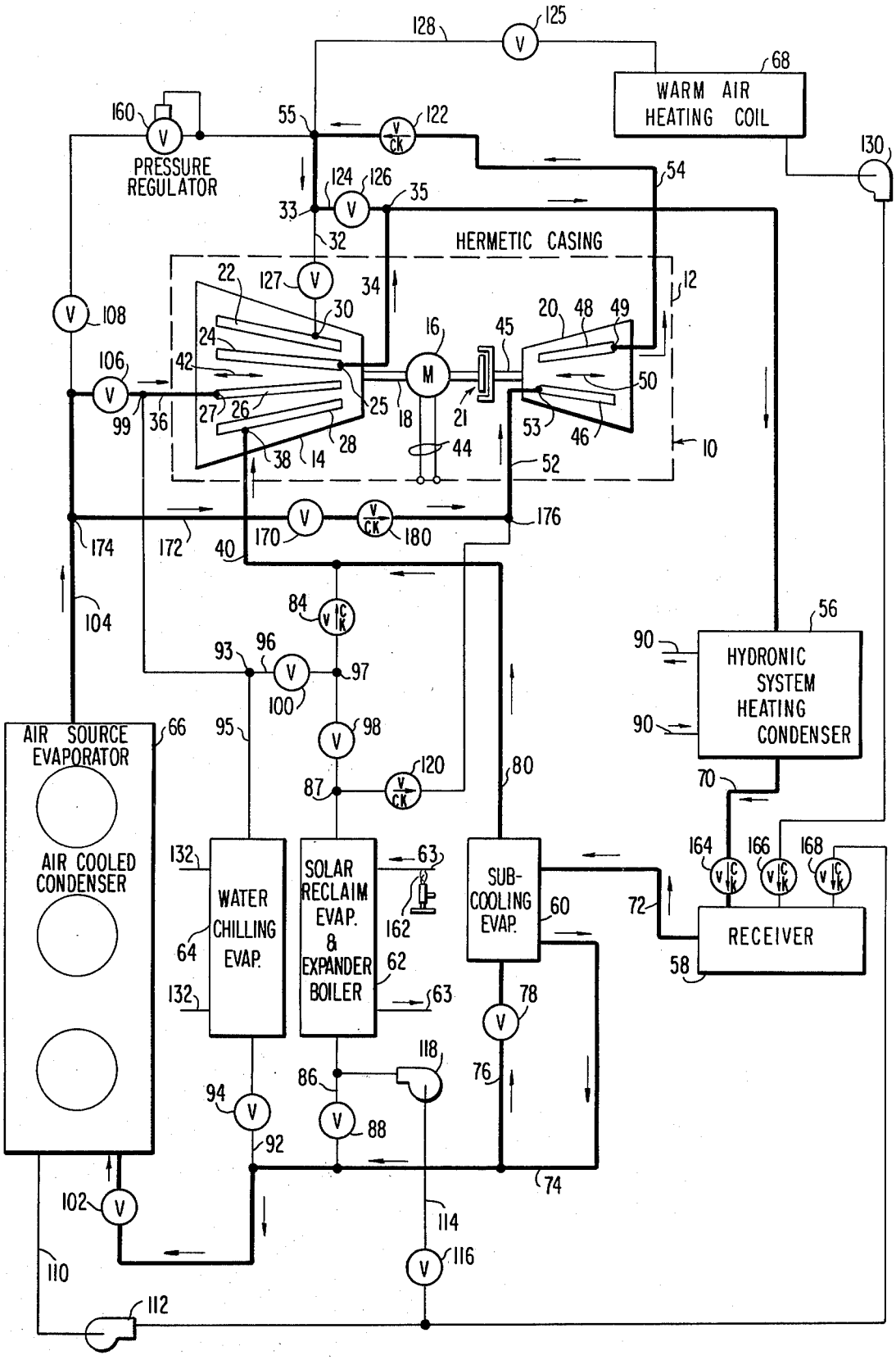
WARM AIR HEATING COIL
PRESSURE REGULATOR
HERMETIC CASING
HYDRONIC SYSTEM HEATING CONDENSER
AIR SOURCE EVAPORATOR
AIR COOLED CONDENSER
WATER CHILLING EVAP.
SOLAR RECLAIM EVAP. & EXPANDER BOILER
SUB-COOLING EVAP.
RECEIVER

AIR SOURCE HEAT PUMP WITH DISPLACEMENT DOUBLING THROUGH MULTIPLE SLIDE ROTARY SCREW COMPRESSOR/EXPANDER UNIT

REFERENCE TO RELATED PATENT

This application relates to an improvement to U.S. Pat. No. 4,086,072 entitled "AIR SOURCE HEAT PUMP WITH MULTIPLE SLIDE ROTARY SCREW COMPRESSOR/EXPANDER" issuing Apr. 25, 1978, to applicant and assigned to the common assignee.

BACKGROUND OF THE INVENTION

Field of the Invention

This invention relates to a closed loop refrigeration system such as a heat pump system which employs multiple slide valves in a helical screw compressor/expander unit where the expander may be employed to drive the compressor and simultaneously the compressor drive induction motor. The motor acts as a generator and thereby feeds electrical energy back into the electrical transmission system to that motor, etc.

BACKGROUND OF THE INVENTION

U.S. Pat. No. 4,086,072 provides such an air source heat pump system which incorporates a helical screw rotary expander and a similarly constructed helical screw rotary compressor within the system and means are provided for coupling the expander to the compressor through the drive motor such that the expander may act to drive the compressor by overspeeding the rotor of the induction motor and to simultaneously deliver electrical power to the power network feeding the drive motor, particularly at low compressor loading. The system preferably employs multiple coils functioning as evaporators and condensers within the system. The helical screw rotary compressor includes multiple slide valves wherein refrigerant vapor at a pressure intermediate of suction and discharge pressure for the compressor may be returned to the compressor through an injection port carried by one of the slide valves and removed from the compressor as partially compressed refrigerant vapor from an ejection port carried by another slide valve. Further, the expander, which is selectively clutchable through a clutch mechanism to the drive motor and which may be thus kept out of a drive arrangement between that motor and the helical screw rotary compressor, bears like plural slide valves. One controls the inlet port to the compressor and the other controls the outlet port, so as to permit varying the capacity of the expander as well as changing the volume ratio of the unit and/or match the discharge pressure at the outlet port to a closed thread pressure within the helical screw expander just prior to opening to that discharge port.

In this type of system, a subcooling evaporator coil may be employed for subcooling the liquid refrigerant received from any one of the coils functioning as the system condenser prior to feeding that liquid refrigerant to a coil or coils functioning as system evaporators and upstream of those elements, and wherein the vapor flashed during subcooling at intermediate pressure is returned to the helical screw compressor via the injection port of the injection slide valve.

Further, the ejection port of the ejection slide valve permits the removal of partially compressed refrigerant vapor, that is, compressed to a pressure less than full discharge pressure for the compressor, to be supplied to one of the condensing coils operating at a lower temperature and functioning as the low pressure condenser for the system. System efficiency is enhanced by matching compressor pressure levels, both available from and available to the system, to the condenser and evaporator coil pressures.

It is an object of the present invention to provide for such a closed loop refrigeration system, the capability of permitting both the compressor and the expander to function in compressor mode, thereby increasing the capacity of the system and permitting the air source evaporator to supply heat necessary to adequately take care of heating loads as experienced by multiple coils functioning as system heating condensers, as for instance when the system constitutes an air source heat pump.

SUMMARY OF THE INVENTION

The present invention is directed to a closed loop refrigeration system such as an air source heat pump system in which a helical screw expander is coupled to a drive motor which is also coupled to drive a helical screw rotary compressor. The compressor and the expander include multiple longitudinally shiftable slide valves. The compressor comprises at least a suction or capacity control slide valve and a pressure matching or discharge slide valve. The expander bears slide valves to control entry of refrigerant vapor to the expander and to control the discharge of that vapor from the expander. The system further comprises at least one coil functioning as a condenser and preferably at least one coil functioning as an evaporator. Conduit means connect the evaporator and condenser and said compressor through the first and second slide valves in a closed loop refrigeration circuit. The improvement resides in said conduit means further comprising means for supplying a portion of the return vapor from the coil functioning as an evaporator to the inlet side of the expander and for connecting the outlet side of the expander to the coil or coils functioning as the system condenser in parallel with refrigerant flow through the compressor to that coil or coils. Means are provided for driving both the compressor and the expander by the drive motor to thereby utilize the expander as a compressor and for increasing the refrigerant capacity of the compressor/expander unit and to increase heat exchange action by the coil functioning as the condenser in the system.

The system may include a subcooling evaporator for returning vaporized refrigerant to a third slide valve carried by the compressor acting as an injection slide valve. The system may further include a second condenser coupled to the compressor on its discharge side through a fourth slide valve acting as an ejection slide valve to permit the coil to function as a low temperature, low pressure condenser in parallel with the primary high pressure system condenser. Preferably, the system further comprises a solar reclaim evaporator and expander boiler which may receive liquid refrigerant and which may be heated by a solar loop or a fossil fuel burner with vapor returned to the suction port controlled by the capacity control slide valve, the injection slide valve for the injection port of the compressor, or to the inlet port to the expander. Relative to the latter, the expander functions in an expansion mode and thereby drives the compressor and/or the motor to cause the induction motor to function as a generator with the vapor discharge from the expander in the expansion mode being directed to a system condenser as an additional system heat supply.

BRIEF DESCRIPTION OF THE DRAWING

The single FIGURE is a schematic diagram of a closed loop refrigeration system in the form of an air source heat pump constituting one embodiment of the present invention.

DESCRIPTION OF THE PREFERRED EMBODIMENT

The present invention comprises an improved, closed loop refrigeration system with the illustrated embodiment constituting a high efficiency heat pump. A helical screw rotary compressor/expander hermetic package unit indicated generally at 10 comprises a hermetic casing 12 within which is housed a helical screw rotary compressor 14 and an electric drive motor 16. The motor 16 preferably comprises an electrical synchronous induction motor and preferably is fixedly mechanically coupled to the screw compressor 14 by way of shaft 8 for direct drive of one of the compressor helical screws. Also provided within casing 12 is a helical screw rotary expander 20 of essentially the same form as the compressor and which may be a duplicate of that unit. A selectively energizable clutch indicated generally at 21 functions to selectively, mechanically couple the expander 20 to the drive motor 16. The helical screw rotary compressor and the expander are helical screw rotary positive displacement machines such as the type shown in U.S. Pat. No. 4,058,988, and the compressor 14 preferably comprises four axially or longitudinally adjustable side valves indicated schematically at 22, 24, 26 and 28. Slide valve 22 constitutes an ejection slide valve and carries ejection port 30 which permits vaporized working fluid partially compressed between the suction and full discharge pressure to be ejected from the compressor via port 30. Slide valve 24 constitutes a discharge or volume ratio control slide valve and preferably incorporates a pressure sensing means for measuring the pressure of a closed thread adjacent to a discharge port 25 and matches that closed thread pressure to the discharge line pressure within a discharge line 34 open thereto at discharge port 25 and thereby prevents compressor undercompression and overcompression as per U.S. Pat. No. 4,058,988.

Slide valve 26 constitutes the capacity control slide valve for the compressor and effects unloading of the compressor by permitting a portion of the suction gas entering the compressor 14 at suction port 27 from a suction line 36 to return to the suction side of the machine without being compressed. Slide valve 28 constitutes an injection slide valve and carries an injection port 38 and permits vaporized working fluid to be returned to the compressor at a closed thread pressure which is intermediate of the suction pressure at port 27 and the discharge pressure at port 25. All of the slide valves 22, 24, 26 and 28 are axially or longitudinally shiftable with respect to the compressor casing 14, as indicated by double headed arrow 42, this being accomplished under a control system essentially the same as that shown in U.S. Pat. No. 4,058,988.

As stated previously, the helical screw rotary expander 20 is essentially identical to compressor 14 and thus may operate both as a compressor and expander. However, when operating as an expander, the high pressure vapor which enters the inlet or feed port 53, during expansion, drives the intermeshed helical screws relative to each other and provides a rotary output to shaft 45 which, through clutch 21, then acts to positively drive the rotor of the induction motor 16 when employed in this fashion. For purposes of the present improvement, however, when the clutch 21 is energized, by supplying electrical power through leads 44 to the motor 16, both the compressor 14 and the expander 20 are driven positively with both units functioning as compressors. In that case, slide valve 46 carried by the expander 20 functions to vary the capacity of the unit as a compressor, while the second slide valve 48 corresponding to slide valve 24 of the compressor 14 is shifted to control the volume ratio of the compressor and preferably to match the pressure within a closed thread of the expander 20 just before discharge at discharge or outlet port 49 feeding to line 54. Since the unit under this mode is functioning as a compressor, this prevents undercompression and overcompression of the working fluid within this portion of the hermetic unit. Again, the means for shifting the slide valves 46 and 48 and their control is essentially the same as that set forth in the patent referred to above.

The hermetic unit 10 comprises one component within the closed loop refrigeration system which further includes hydronic system heating condenser or coil 56, receiver 58, subcooling evaporator or coil 60, solar/reclaim evaporator and expander boiler or coil 62, water chilling evaporator or coil 64, air source evaporator/air cooled condenser or coil 66, and warm air heating coil 68. These elements with the exception of receiver 58 constitute heat exchangers for heat exchange between the refrigerant working fluid carried within the closed loop, such as R22, the atmosphere as a source of such heat or as a means of rejection of the same and the building or equivalent space or means to be conditioned via the warm air heating coil 58, the hydronic system heating condenser 50 and water chilling evaporator 64.

The compressor discharge line 34 connects the discharge port 25 of the compressor 14 to the inlet side of the hydronic system heating condenser 56. Line 70 leads from that coil to the receiver and bears a check valve 164, permitting flow to the receiver from the unit but not vice versa. Line 72 leads from receiver 58 and connects to the subcooling evaporator 60, where the liquid refrigerant is subcooled by use of a bleed line 76 which returns to the subcooler from a tap point within liquid refrigerant supply line 74 downstream of the subcooler through control valve 78. Line 74 conducts the subcooled refrigerant liquid to any one of coils 62, 64 and 66 functioning as evaporators for the system. The vaporized refrigerant tapped from line 74 and vaporized at subcooler 60 is returned to the compressor and specifically to the injection port 38 of the injection slide valve 26 through line 80. Return line 80 opens to the compressor injection line 40 at a point 82 which is downstream of check valve 84 to insure that regardless of operation of the system, the subcooling vaporized refrigerant at intermediate pressure is injected into the helical screw compressor 14 at a point in the compression process intermediate of the suction and discharge pressures. The refrigerant supply line 74 is connected to the solar/reclaim evaporator and expander boiler 62, by way of branch line 86 through a control valve 88, where the liquid refrigerant is vaporized and returned to point 82, line 86 connecting to line 40 which leads to the injection port 38 of the injection slide valve 26. A suitable solar loop fluid such as glycol may carry thermal energy to the solar reclaim evaporator and expander boiler 60 via lines 63 and permit thermal energy to be removed from that heat transfer media. Further, the system preferably includes a fossil fuel heating element such as schematically illustrated by the flame at 162, permitting the glycol to effect boiling of refrigerant within the coil 62, with coil 62 functioning as an expander boiler under these circumstances. Line 86, between the solar reclaim evaporator and expander boiler and point 82 within line 80, bears a control valve 98 and a check valve 84. Further, a line 96 connects to line 86 at point 97 and bears control valve 100 to permit, selectively, the refrigerant to return to the compressor suction or inlet port 27 controlled by the capacity control slide valve 26. Line 96 intersects the suction line 36 at point 99 just upstream of the suction port 27 of the compressor 14. A water chilling evaporator coil 64 may selectively receive subcooled refrigerant liquid by way of line 92 from the supply line or manifold 74 under the control of valve 94. Heat picked up during chilling of the water is returned to the compressor via line 95 which connects to line 96 at point 93 on the opposite side of valve 100 from connection point 97 to line 86. Water is supplied to the water chilling evaporator 64 and returned therefrom through lines 132. The supply line 74 leads to the air source evaporator/air cooled condenser coil 66 with the supply controlled by valve 102. Line 104 functions to connect the air source evaporator/air cooled condenser coil 66 to the vapor return line 36. Line 36 includes a control valve 106 to selectively permit the vapor to return from air source evaporator/air cooled condenser coil 66 to the inlet port 27 of the compressor 14 as desired. Unit 66 acts as an air source evaporator when picking up heat and as an air cooled condenser when rejecting heat. Ejection slide valve 22 under its control acts such that the ejection port 30 picks up a portion of the compressed refrigerant which is not fully compressed to full discharge pressure as at port 25 and may direct selectively, that vapor to either the warm air heating coil 68 or the hydronic system heating condenser 56, when coil 68 or 56 functions as the system low pressure condenser. In that regard, line 32 leads to coil 68 but additionally at point 33 and via line 124 which bears the control valve 126, permits the compressed refrigerant to pass to line 34 and enter the same at point 35 so as to selectively deliver refrigerant vapor, at less than full compressor discharge pressure, to the hydronic system heating condenser 56. Normally, the warm heating coil 68 receives the partially compressed refrigerant vapor and functions as a low pressure, low temperature condenser relative to the hydronic system heating condenser 56 which normally receives refrigerant vapor at full compressor discharge pressure and functions as the system high pressure, high temperature condenser. A control valve 127 in line 33 permits that line to be shut off, as desired.

A portion of the building, for instance, may be heated at a lower temperature than that provided by the heating condenser 56 and separately from that portion of the system. After condensing within the warm air heating coil 68, the condensed liquid refrigerant is pumped by pump 130 through line 128 to receiver 58 where it combines with the liquid refrigerant emanating from the hydronic system heating condenser 56 at the higher pressure. Under normal control, if the water leaving or returning to the hydronic system condenser 56, as through lines 90, starts to rise above a desired set point, capacity control slide valve 26 of the compressor 14 will close down the gas suction port 26 to the compressor.

With respect to the expander 20, line 86 at point 87, on the opposite side of the solar reclaim expander coil 62 from the supply line 74, effects the connection between that unit 62 and the inlet port 53 to the expander 20. Line 52 bears a check valve 120 permitting flow to the expander 20 plus under a given mode of operation either when coil 62 is functioning as an evaporator to place heat in the system from a solar collector or the like by way of the glycol within lines 63 or where, by way of fossil fuel flame 162, heat is placed into the system. The high pressure vapor discharging from that unit may be employed in driving the helical screw rotors within expander 20 to permit the expander to drive the compressor 14, and if further energy is available, to feed electricity back to the transmission line or power network through lines 44 from the motor 16 which is functioning at that moment as an induction generator. Vapor returns to the system for condensation after discharging from the unit 20 functioning as an expander through line 54 via the discharge port 49 and through check valve 122, line 54 connecting to line 32 at point 55. The expanded vapor may pass to the warm air heating coil 68 for condensation or by way of line 124 and control valve 126 to the hydronic system heating condenser 56 and thence to the receiver. Valve 125 in line 128 controls flow to coil 68.

Additionally, line 104 extends from the air source evaporator/air cooled condenser 66 to line 32, connecting thereto at point 55, and bears a pressure regulator 160 and a control valve 108 such that the air source evaporator/air cooled condenser may function as a condenser by feeding compressed refrigerant vapor from line 32 through pressure regulator 160 and control valve 108 to coil 66, with control valve 106 closed. Pressure regulator 160 insures sufficient pressure of refrigerant vapor discharged from the compressor via ejection port 30 of ejection slide valve 22 for flow to coil 66 functioning in this case as an air cooled condenser in contrast to the other control valves within the system.

A line 110 leads from the air source evaporator/air cooled condenser 66 to the receiver 58 and bears pump 112, such that when coil 66 functions as the low pressure condenser, since it is connected to the ejection port 30 of the ejection slide valve 22, the pressure of the condensed refrigerant must be raised to that of the receiver pressure 58 so as to pass through check valve 168 within that line 110.

The improvement of the present invention involves the utilization of an auxiliary thermal energy supply line 172 which connects at one end to line 104 at point 174 and to line 52 at point 176 at the other end. The auxiliary thermal energy supply line 172 bears a control valve 178 and a check valve 180 to permit refrigerant flow from line 104 to line 52 but not vice versa. Control valve 170, like all of the control valves discussed previously, constitutes preferably a solenoid operated control valve which, when de-energized, is closed and, when energized, is open. Further, they may be controlled selectively by thermostats and the like in the manner of the patent referred to above.

In terms of the improvement over U.S. Pat. No. 4,086,072, upon energization of the solenoid operated control valves 170 and 126 and engagement of clutch 21, the supply of electrical power through lines 44 from a network to the motor 16 causes the induction motor to drive both unit 14 and unit 20 as compressors. Further, and preferably, as illustrated in the single figure, heat is picked up by the air source evaporator/air cooled condenser coil 66 functioning in an evaporative or heat supply mode with refrigerant in vapor form being directed through line 104 to vapor return line 36 and returning to the inlet port 27 of the compressor for full compression and discharge at discharge port 25. The compressed refrigerant vapor flows to the hydronic system heating condenser 56 for condensation and heating of the water within the loop including piping 90. It is assumed that the system is operating as an air source heat pump, in which case the hydronic system heating condenser 56 is part of a hydronic heating loop within a building having space to be conditioned. Further, some of the refrigerant vapor within line 104 passes via the auxiliary supply line 172 and line 50 to the inlet port or feed port 53 of the unit 20 which is operating under compression mode as a capacity doubler. The refrigerant vapor is compressed between the helical rotary screw rotors, discharging at the discharge port 49 and passing via line 54 and check valve 122 to line 32. In the illustrated mode, this vapor merges with the compressed vapor discharging from the discharge port 25 of the compressor 14 and passes to the hydronic system heating condenser 56 which is under heavy heating load. This provides sufficient heat to the space to be conditioned via the primary high pressure condenser 56. The condensed refrigerant passes to receiver 58. Control valve 125 is closed and valve 126 open. Ejection slide valve 22 has its ejection port closed off and vapor at full discharge pressure from expander 20 functioning as a compressor passes to coil 56 along with the full discharge of compressor 14 via line 34. Valve 127 may be closed. The liquid refrigerant within the receiver passes to the subcooling evaporator 60, where it is subcooled, discharging through the supply line 74 to the air source evaporator/air cooled condenser acting as the source for the system. The vaporized refrigerant emanating from bleed line 76 with control valve 78 open, returns through lines 80 and 40 to the injection port 38 of injection slide valve 28, where it enters at an intermediate pressure point of the compression process of unit 14 for compression along with the vapor directed to that machine via suction port 27.

The system is particularly operational in this mode at times of relatively low ambient temperature, where the compressor 14 is incapable of transferring sufficient heat from the air source evaporator to the heating condenser as at 46 to meet the load requirements for the system absent the utilization of expander 20 in its compression mode with both units 14 and 20 being driven by the drive motor 16.

It should be realized that where coils such as 62, 64 and 66 are functioning as evaporators, it is necessary to provide thermal expansion valves to effect expansion of the refrigerant at the point of heat pick-up as is conventional in refrigeration systems. These elements have purposely not been illustrated since they are of a conventional nature and their need and function are well known to all skilled in that art.

Further, certain elements may be eliminated such as given coils as well as the clutch 21 in which case the compressor 14 and expander 20 would be mechanically coupled together and through the drive motor 16 or otherwise interconnected to achieve the desired function of utilizing the expander 20 to drive the compressor 14 and/or drive motor 16 as an induction generator or alternatively to have the drive motor 16 drive both units 14 and 20 as compressors as in the desired mode of operation exemplifying the instant invention.

While the invention has been particularly shown and described with reference to a preferred embodiment thereof, it will be understood by those skilled in the art that various changes in form and details may be made therein without departing from the spirit and scope of the invention.

What is claimed is:

1. In a closed loop refrigeration system including:

a helical screw rotary compressor including a suction port and a discharge port, a helical screw rotary expander including a feed port and a discharge port, means for mechanically connecting said expander to said compressor, motor means for driving said compressor and said expander, a first heat exchange coil for conditioning a space and the like, a second heat exchange coil, said compressor comprising a plurality of axially adjustable compressor slide valves including at least a capacity control slide valve for unloading the compressor, conduit means carrying refrigerant and forming a primary closed loop refrigeration circuit for connecting said screw compressor and said first and second coils in series, in that order, a third heat exchange coil connected intermediate of said first and second coils to receive condensed refrigerant from the coil functioning as the system condenser and having its outlet side connected to the inlet of said expander, and means for connecting the outlet port of said expander to the coil functioning as the system condenser to permit expansion of working fluid within said expander and to thereby drive said compressor absent energization of said drive motor, the improvement comprising:

an auxiliary supply line connecting the outlet of said coil functioning as the system evaporator when in heat pick up mode to said expander inlet port and including selectively operable valve means such that upon energization of said drive motor and opening of said selectively operable valve means, said coil functioning as the system evaporator feeds vaporized refrigerant at low pressure both to said compressor and simultaneously to said expander for compression to essentially double the displacement of said system and increase the acceptable heat transfer load of the coil functioning as system condenser.

2. The closed loop refrigeration system as claimed in claim 1, wherein said compressor slide valve further includes an injection slide valve including an injection port and an ejection slide valve including an ejection port, said expander comprises at least a capacity control slide valve and a volume ratio control slide valve at said expander discharge port, said system includes a subcooling evaporator including a subcooler vapor return line connected to the injection port of said injection slide valve of said compressor and a fourth coil connected to the ejection port of said ejection slide valve of said compressor to permit said fourth coil to function as a system low pressure, low temperature condenser, and wherein said system further comprises means for selectively connecting the discharge port of said expander to either the inlet side of said first or said fourth coil such that said compressor and said expander acting in compressive mode, functions to meet the condensing needs of said first coil alone, said fourth coil alone, or both coils together.

* * * * *